United States Patent [19]

Jones et al.

[11] Patent Number: 5,056,435

[45] Date of Patent: Oct. 15, 1991

[54] INFRARED ILLUMINANT AND PRESSING METHOD

[76] Inventors: Leon L. Jones, 344 W. Pleasant View, Ogden, Utah 84414; Daniel B. Nielson, 407 E. 1st South, Brigham City, Utah 84302

[21] Appl. No.: 443,658

[22] Filed: Nov. 29, 1989

[51] Int. Cl.[5] ..... F42B 4/26; F42B 3/00; F42B 33/00

[52] U.S. Cl. ..... 102/336; 86/20.11; 86/45; 149/22; 149/41; 149/61; 149/116

[58] Field of Search ..... 102/336; 86/20.11, 45; 149/22, 41, 61, 116

[56] References Cited

U.S. PATENT DOCUMENTS

| | | | |
|---|---|---|---|
| 3,411,964 | 11/1968 | Douds | 149/19 |
| 3,733,223 | 5/1973 | Lohkamp | 149/19 |
| 3,951,705 | 4/1976 | Mancinelli et al. | 149/41 |
| 4,204,895 | 5/1980 | Webster, III | 149/19.6 |

*Primary Examiner*—Peter A. Nelson

[57] ABSTRACT

An infrared illuminant composition and flares produced therefrom having increased burn rate and increased infrared intensity while maintaining low visible light intensity. The composition comprises potassium nitrate, cesium nitrate, hexamine, boron, silicon, ferric oxide and a binder. A process to produce infrared illuminant flares prevents or substantially eliminates chunking out of burning pieces of the illuminant at pressing increments in the flares.

26 Claims, 1 Drawing Sheet

INFRARED ILLUMINANT AND PRESSING METHOD

FIELD OF THE INVENTION

The invention relates to infrared illuminant compositions and flares produced therefrom and useful to enhance the use in night vision devices such as goggles. The invention also relates to a process for producing infrared illuminant flares to prevent chunking out of pieces of the illuminant at pressing increments during burning.

BACKGROUND OF THE INVENTION

Infrared illuminant flares have been proposed for use in enhancing the use of night vision devices such as night vision goggles. Generally, it is desirable that such flares be ones that produce light predominantly or almost exclusively in the infrared region with the production of little or substantially no visible light. Such infrared illuminant flares are quite useful where it is desirable to conduct operations in a hidden, sheltered, masked or concealed manner, i.e. in a manner not generally visible to others or those without benefit of the aforementioned night vision devices.

Infrared illuminant compositions and flares proposed heretofore have suffered from a number of drawbacks. Among the drawbacks is the low infrared intensity, slow burn rate and the side burning and the related chunking out of big pieces of illuminant at pressing increments of the illuminant composition in the flares during burning. Another serious drawback to such proposed infrared illuminants is the undesirable presence of visible light during burning of the compositions.

Thus, a need exists for an infrared illuminant composition and flares produced therefrom that exhibits an increased or accelerated burning rate, and also exhibits an increased infrared intensity while maintaining a low visible light intensity. A further need exists for such improved infrared illuminant flares that are substantially free of side burning and the related chunking out of big pieces of illuminant at the pressing increments in the flares during burning. It is desirable that an infrared illuminant composition and flares therefrom be provided which enhance the use of the night vision sensitive devices such as infrared goggles by producing increased illumination without any significant increase in visible light. A further object of this invention is to provide an infrared illuminant composition and flares therefrom that provide increased infrared intensity in the wavelengths of from about 700 to about 1100 nanometers. A still further object of this invention is to provide an infrared illuminant composition and flares therefrom which have reduced or substantially no soot formation during burning. It is highly desirable that an infrared illuminant be provided that has maximum infrared light intensity, minimal visible light intensity, increased burn rate and no chunking out of pieces of illuminant during burning.

SUMMARY OF THE INVENTION

Figure 1A:
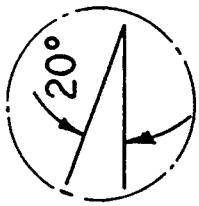
FIG. 1 is a plan view of a multi-stepped pressing foot employed to produce improved infrared illuminant flares.

Infrared illuminant compositions and infrared illuminant flares produced therefrom are provided by a composition comprising potassium nitrate, cesium nitrate, hexamine, silicon, boron, ferric oxide and a suitable binder. Infrared illuminant flares are provided with substantially no side burning or chunking out of pieces of illuminant during burning by use of a multi-stepped pressing foot to pack the illuminant composition in flare tubes.

DETAILED DESCRIPTION OF THE INVENTION

Infrared illuminant compositions of improved burn rate, increased infrared light intensity with minimal visible light intensity and substantially no chunking out of illuminant during burning of an infrared illuminant flare is provided by a composition which comprises the following compositions:

| Component | Weight percent |
|---|---|
| Potassium nitrate | about 50 to 70%, preferably about 60% |
| Cesium nitrate | about 9 to 20%, preferably about 9 to 10% |
| Hexamine | about 14 to 18%, preferably about 15 to 16% |
| Silicon | about 5 to 10%, preferably about 6 to 7% |
| Boron | about 1 to 3%, preferably about 2% |
| Ferric oxide | about ½ to 1½%, preferably about 1% |
| Binder | about 4 to 8%, preferably about 6% |

wherein the total weight of all the components together comprises 100%.

As a binder for the composition one may employ any suitable binder that does not adversely affect the characteristic of the infrared illuminant composition or the flares produced therefrom. Preferably, the polymer will be, for example, a polyester containing short carbon fragments in the backbone so as to reduce or eliminate soot formation during burning. As an example of a suitable binder there may be mentioned Formrez F 17-80 polyester of Witco Chemical Corp. and more particularly, a curable polyester resin composition comprising, by weight, from about 81 to about 83% to, preferably about 82.5% Formrez 17-80 polyester resin, about 15 to about 17%, preferably about 16.5% epoxy such as ERL 510 of Ciba-Geigy Corporation and about 0 to about 2%, preferably 1% of a catalyst such as iron linoleate. Most preferably the about 4% by weight of a binder comprised of about 82.5% Formrez 17-80 polyester resin, about 16.5% ERL 510 epoxy and about 1% iron linoleate is employed as the binder in the preferred infrared illuminant compositions of this invention. Such a binder composition is hereinafter simply referred to as WITCO 1780.

A preferred infrared composition of this invention comprises the following composition:

| Component | Weight percent |
|---|---|
| Potassium nitrate | about 60% |
| Cesium nitrate | about 9% |
| Hexamine | about 15% |
| Silicon | about 7% |
| Boron | about 2% |
| Ferric oxide | about 1% |
| WITCO 1780 | about 6%. |

A most preferred infrared illuminant composition of this invention comprises:

| Component | Weight percent |
|---|---|
| Potassium nitrate | 58.75% |
| Cesium nitrate | 9.79% |
| Hexamine | 15.67% |
| Silicon | 6.85% |
| Boron | 1.96% |
| Ferric oxide | 0.98% |
| WITCO 1780 | 6.00%. |

As other examples of infrared illuminant compositions of this invention there may be mentioned the following exemplary compositions:

| Component | Weight percent Composition | |
|---|---|---|
| | A | B |
| Potassium nitrate | 60.0% | 60.0% |
| Cesium nitrate | 9.0% | 10.0% |
| Hexamine | 15.0% | 16.0% |
| Silicon | 7.0% | 7.0% |
| Boron | 2.0% | 2.0% |
| Ferric Oxide | 1.0% | 1.0% |
| WITCO 1780 | 6.0% | 4.0% |

With the infrared compositions of this invention infrared intensity and burn rate were increased significantly. Infrared intensity increases of up to about 150% and burn rate increases of up to about 110% were achieved without adversely increasing the visible light compared to the herebefore proposed infrared illuminants comprising, based on weight, 70% potassium nitrate, 10% silicon, 16% hexamine and 4% of a fluorocarbon binder such as a fluorocarbon based on a copolymer of vinylidene fluoride and hexafluoropropylene available from EI duPont as VITON A.

The infrared illuminant compositions were evaluated based on a concealment index which is the ratio of infrared light of visible light observed when burning. The test equipment for determining the index comprised a photometric silicon detector and a photovoltaic silicon detector. The photometric detector has a filter that follows the response of the human eye (visible detector). The photovoltaic detector uses a filter that blocks out all light below 700 nanometer and allows only light greater than 700 nanometer to pass (infrared detector). The upper limit of the photovoltaic detector is 1,100 nanometers, providing the filtered detector a range of between 700 to 1,100 nanometers.

In the compositions of this invention silicon and hexamine are employed as the main fuel components because their combustion products have minimal visible light output, i.e. both have good concealment indexes. Potassium nitrate is employed as an oxidizer in the compositions of this inventor. While potassium perchlorate was found to increase the burn rate of infrared illuminant compositions when employed as an oxidizer therein it also undesirably and unacceptably increased the visible light even at reduced percentage levels in the composition. Potassium nitrate produced a very low visible light output and thus had a good concealment index, however, the burn rate was neither fast enough or increased sufficiently to produce an acceptable infrared illuminant flare.

As burn rate catalysts both boron and magnesium were evaluated at low levels in the composition to increase the burn rate. However, magnesium produced too much visible light to be acceptable. Boron, on the other hand, was found to increase the burn rate up to about 50% with only slight increases in visible light when employed at about 2 to 3% by weight in the composition. When ferric oxide was employed in the composition at about 1% by weight it had no effect on burn rate. However, it was unexpectedly discovered that when boron and ferric oxide were used together in the compositions dramatic increases in the burn rate could be achieved. For example, burn rate increases of up to 110% were observed with slight increases in the visible light when 2% boron and 1% ferric oxide were employed in the compositions. In addition increases measuring 150% in the infrared light intensity were also observed.

Cesium nitrate is present in the compositions of this invention as an oxidizer and also to aid in accelerating the burn rate. More importantly, however, cesium nitrate has been found to broaden the infrared spectral output and improve the infrared efficiency. The potassium nitrate and cesium nitrate appear to augment the action of each other.

All these ingredients have been found to favorably affect the burn rate significantly without adversely affecting the visible light output. Ferric oxide, boron and cesium nitrate when used together in the infrared illuminant compositions of this invention increase the burn rate from 0.025 to 0.055 in./sec. and more than double the infrared intensity from 400 to 1,060 watts/steradian in the wavelength band of from 700 to 1100 nanometers while only increasing the visible light intensity from 2,000 to 3,000 candlepower for a 2.75 in. (69.85 mm) diameter flare.

The compositions of this invention may be prepared in any suitable manner. For example, into a Muller mixer one adds the oxidizer and then the binder polymer (e.g. WITCO 1780) and mixes these components until the mixture is all wetted and homogenous, generally for about fifteen minutes. Then, to this mixture the fuels and burn rate catalysts are added and mixed until all the components are wetted with the binder polymer and a homogenous mixture is produced which is suitable for packing in a flare casing.

Infrared illuminant flares are produced by pressing the illuminant composition into suitable flare cases, such as for example, 2.75 in. (69.85 mm) diameter suitably lined aluminum cases. The tubes or flares can be any suitable length but are preferably about 9 or 18 inches (228.6 or 457.2 mm) in length. While the illuminant composition can be pressed into the case in any suitable manner it has been discovered that by the use of a novel multi-stepped pressing foot designed for this purpose flares with reduced chunking out and side burning can be produced. Such a multi-stepped pressing foot is disclosed in FIG. 1. The use of such a multi-stepped pressing foot to press the infrared illuminant compositions into flare cases produces flares which are substantially free of chunking and essentially eliminates the separation and ejection of pressed increments of the illuminant composition by increasing the illuminant density near the case wall. This essentially eliminates the low density illuminant areas where side burning occurs. Thus, by reducing side burning, the related chunking is also reduced. Pressing is generally accomplished at a pressure of about 8,000 to about 10,000 psi ($5.625\times10^6$ to $7.031\times10^6$ kg/m$^2$). The pressed material is extremely hard which makes illuminant cutback nearly impossible. For the longer 18 in. (457.2 mm) cases the illuminant composition is pressed into the case in about 12 increments and the resulting grain is about 13.3 in. (337.82 mm), while for the shorter 9 in. (228.6 mm) cases the illuminant composition is pressed into the case in about 6 increments an the resulting grain is about 4.3 in. (109.22 mm) in length.

Figure 1:
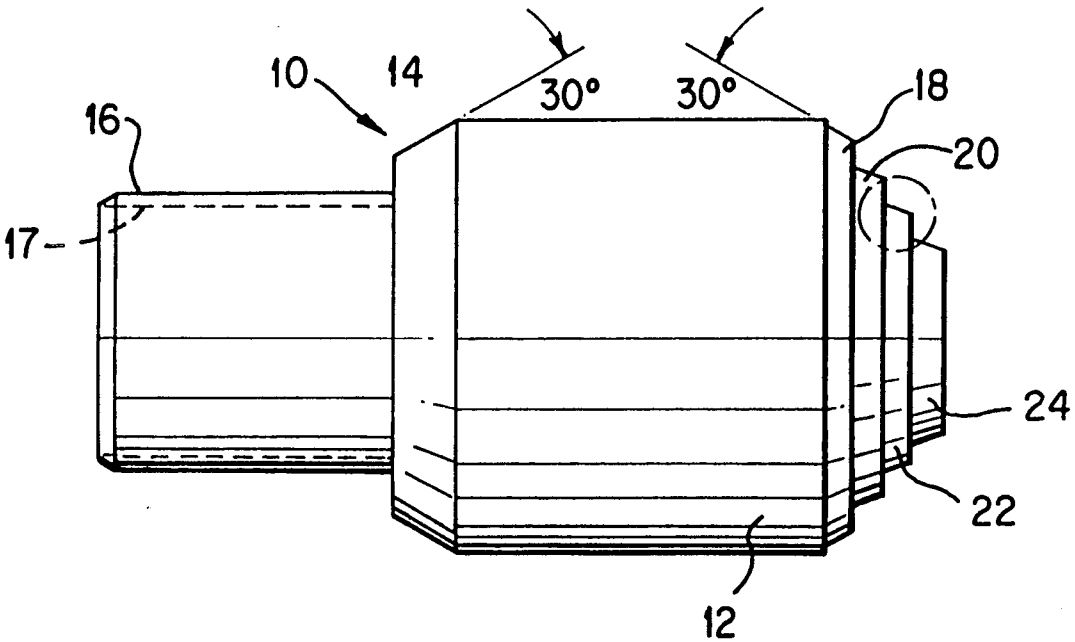

Referring to FIG. 1 a multi-stepped pressing foot suitable for use in producing illuminant flares is illustrated. The multi-stepped pressing foot, designated generally by the reference numeral 10, comprises a main cylindrical body member 12. At one end 14, body number 12 is provided with an inwardly tapered portion (tapered toward the axis of cylindrical body 12) which is connected to a mounting post 16 having attaching means 17 for attaching the foot 10 to a suitable pressure-providing device (not shown). At the other end 18 of said cylindrical body 12 the body is likewise provided with an inwardly tapered first step portion which is connected to a plurality, preferably three, of progressively smaller diameter inwardly tapered, trapezoidally shaped (parallel in the axial direction) circular steps 20, 22 and 24. In a preferred embodiment of this multi-stepped pressing foot for use in filing 2.75 in. (59.85 mm) diameter flare cases, the outside diameter of body 12 is 2.34 in. (59.436 mm), the angle of taper at ends 14 and 18 is 30% from the axis of body 12, and the angle of taper of steps 20, 22 and 24 is about 20° from the axis of body 12. The smaller diameter of step 24 is 1.0 in. (25.4 mm) and its larger diameter 1.12 in. (28.45 mm). For step 22 its smaller diameter is 1.264 in. (32.106 mm) and the larger diameter is 1.384 in. (35.15 mm). For step 20 its smaller diameter is 1.528 in. (38.81 mm) and its larger diameter is 1.648 in. (41.86 mm).

Although the multi-stepped pressing foot as illustrated in the drawing is suitable for use in producing infrared illuminant flares from the novel compositions of this invention it will be appreciated that such a pressing foot can be employed with other illuminant compositions to produce flares with decreased chunking and side burning.

We claim:

1. An infrared illuminant flare which upon burning has a burn rate of from about 0.055 in./sec., an infrared intensity of about 1,060 watts/steradian and visible light intensity of less than about 3000 candlepower.

2. An infrared illuminant flare comprising a flare casing packed with an infrared illuminant composition in which the illuminant composition comprises:

| Component | Weight percent |
|---|---|
| Potassium nitrate | about 50 to 70%, |
| Cesium nitrate | about 9 to 20%, |
| Hexamine | about 14 to 18%, |
| Silicon | about 5 to 10%, |
| Boron | about 1 to 3%, |
| Ferric oxide | about ½ to 1½%, |
| Binder | about 4 to 8%. |

3. An infrared illuminant flare according to claim 2 in which the illuminant composition comprises:

| Component | Weight percent |
|---|---|
| Potassium nitrate | about 60% |
| Cesium nitrate | about 9 to 10% |
| Hexamine | about 15 to 16% |
| Silicon | about 6 to 7% |
| Boron | about 2% |
| Ferric oxide | about 1% |

-continued

| Component | Weight percent |
|---|---|
| Binder | about 6%. |

4. An infrared illuminant flare composition according to claim 2 wherein the binder is a curable polyester resin composition.

5. An infrared illuminant flare composition according to claim 3 wherein the binder is a curable polyester resin composition.

6. An infrared illuminant flare according to claim 2 wherein the infrared illuminant composition comprises:

| Component | Weight percent |
|---|---|
| Potassium nitrate | about 60% |
| Cesium nitrate | about 9% |
| Hexamine | about 15% |
| Silicon | about 7% |
| Boron | about 2% |
| Ferric oxide | about 1% |
| Curable polyester binder | about 6%. |

7. An infrared illuminant flare according to claim 2 wherein the infrared illuminant composition comprises:

| Component | Weight percent |
|---|---|
| Potassium nitrate | 58.75% |
| Cesium nitrate | 9.79% |
| Hexamine | 15.67% |
| Silicon | 6.85% |
| Boron | 1.96% |
| Ferric oxide | 0.98% |
| Curable polyester binder | 6.00%. |

8. An infrared illuminant flare according to claim 6 wherein the curable polyester comprises a polyester resin, an epoxy and optionally a cure catalyst.

9. An infrared illuminant flare according to claim 7 wherein the curable polyester comprises a polyester resin, an epoxy and optionally a cure catalyst.

10. An infrared illuminant flare according to claim 8 wherein the iron linoleate is present as a cure catalyst.

11. An infrared illuminant flare according to claim 9 wherein the iron linoleate is present as a cure catalyst.

12. An infrared illuminant composition comprising:

| Component | Weight percent |
|---|---|
| Potassium nitrate | about 50 to 70%, |
| Cesium nitrate | about 9 to 20%, |
| Hexamine | about 14 to 18%, |
| Silicon | about 5 to 10%, |
| Boron | about 1 to 3%, |
| Ferric oxide | about ½ to 1½%, |
| Binder | about 4 to 8%. |

13. An infrared illuminant composition according to claim 12 comprising:

| Component | Weight percent |
|---|---|
| Potassium nitrate | about 60% |
| Cesium nitrate | about 9 to 10% |
| Hexamine | about 15 to 16% |
| Silicon | about 6 to 7% |
| Boron | about 2% |

-continued

| Component | Weight percent |
|---|---|
| Ferric oxide | about 1% |
| Binder | about 6%. |

14. An infrared illuminant composition according to claim 12 wherein the binder is a curable polyester resin composition.

15. An infrared illuminant composition according to claim 13 wherein the binder is a curable polyester resin composition.

16. An infrared illuminant composition according to claim 12 comprising:

| Component | Weight percent |
|---|---|
| Potassium nitrate | about 60% |
| Cesium nitrate | about 9% |
| Hexamine | about 15% |
| Silicon | about 7% |
| Boron | about 2% |
| Ferric oxide | about 1% |
| Curable polyester binder | about 6%. |

17. An infrared illuminant composition according to claim 12 comprising:

| Component | Weight percent |
|---|---|
| Potassium nitrate | 58.75% |
| Cesium nitrate | 9.79% |
| Hexamine | 15.67% |
| Silicon | 6.85% |
| Boron | 1.96% |
| Ferric oxide | 0.98% |
| Curable polyester binder | 6.00%. |

18. An infrared illuminant composition according to claim 16 wherein the curable polyester comprises a polyester resin, an epoxy and optionally a cure catalyst.

19. An infrared illuminant composition according to claim 17 wherein the curable polyester comprises a polyester resin, an epoxy and optionally a cure catalyst.

20. An infrared illuminant composition according to claim 18 wherein iron linoleate is present as a cure catalyst.

21. An infrared illuminant composition according to claim 19 wherein iron linoleate is present as a cure catalyst.

22. In a process for pressing an infrared illuminant composition into a flare case the improvement comprising employing a multi-stepped pressing foot for pressing the composition in the case.

23. A process according to claim 22 wherein the multi-step pressing foot exerts a pressure on the infrared illuminant composition in the case of about 8000 to about 10,000 psi ($5.625\times10^6$ to $7.031\times10^6$ kg/m$^2$).

24. A process according to claim 23 wherein the infrared illuminant composition comprises:

| Component | Weight percent |
|---|---|
| Potassium nitrate | about 50 to 70%, |
| Cesium nitrate | about 9 to 20%, |
| Hexamine | about 14 to 18%, |
| Silicon | about 5 to 10%, |
| Boron | about 1 to 3%, |
| Ferric oxide | about ½ to 1½%, |
| Binder | about 4 to 8%. |

25. A process according to claim 23 wherein the infrared illuminant composition comprises:

| Component | Weight percent |
|---|---|
| Potassium nitrate | about 60% |
| Cesium nitrate | about 9% |
| Hexamine | about 15% |
| Silicon | about 7% |
| Boron | about 2% |
| Ferric oxide | about 1% |
| Curable polyester binder | about 6%. |

26. A process according to claim 23 wherein the infrared illuminant composition comprises:

| Component | Weight percent |
|---|---|
| Potassium nitrate | 58.75% |
| Cesium nitrate | 9.79% |
| Hexamine | 15.67% |
| Silicon | 6.85% |
| Boron | 1.96% |
| Ferric oxide | 0.98% |
| Curable polyester binder | 6.00%. |

* * * * *

UNITED STATES PATENT AND TRADEMARK OFFICE

CERTIFICATE OF CORRECTION

PATENT NO. : 5,056,435

DATED : October 15, 1991

INVENTOR(S) : Jones et al.

It is certified that error appears in the above-identified patent and that said Letters Patent is hereby corrected as shown below:

On the title page, the assignee should be

--Thiokol Corporation, Ogden, Utah--

Signed and Sealed this

Twentieth Day of April, 1993

*Attest:*

MICHAEL K. KIRK

*Attesting Officer*

*Acting Commissioner of Patents and Trademarks*